United States Patent [19]

Hall

[11] 3,999,410

[45] Dec. 28, 1976

[54] PORTABLE LOCKING MEANS FOR SKIS

[76] Inventor: Henry V. Hall, 2700 1st Ave. No., Great Falls, Mont. 59401

[22] Filed: Sept. 25, 1975

[21] Appl. No.: 616,593

[52] U.S. Cl. ..... 70/58; 70/18

[51] Int. Cl.[2] ..... E05B 73/00

[58] Field of Search ..... 70/14, 15, 18, 57, 58; 211/60 SK; 280/11.37 K, 11.37 A, 11.37 C

[56] References Cited

UNITED STATES PATENTS

| | | | |
|---|---|---|---|
| 2,999,378 | 9/1961 | Blair | 70/58 |
| 3,091,011 | 5/1963 | Campbell | 70/58 X |
| 3,754,420 | 8/1973 | Oellerich | 70/58 |
| 3,756,048 | 9/1973 | Portus | 70/233 |
| 3,874,202 | 4/1975 | Effenheim | 70/58 |
| 3,935,977 | 2/1976 | Bonnett | 211/60 SK X |

*Primary Examiner*—Robert L. Wolfe

*Attorney, Agent, or Firm*—Barlow & Barlow

[57] ABSTRACT

A generally rectangular open frame having one side movable to admit a pair of skis into the frame and then movable back to complete the rectangular frame and hold the skis therein, also including a reel pivotally attached to another side of the frame with a cable wound on the reel which cable may be unwound and placed about some fixed post and be returned to the frame with a lock securing the frame closed with the skis therein and the cable locked to the frame. The reel when free of the skis may have the cable wound upon the spool and the spool then pivoted into the opening of the frame to be maintained in a compact position for storage.

8 Claims, 5 Drawing Figures

PORTABLE LOCKING MEANS FOR SKIS

BACKGROUND OF THE INVENTION

Ski locks have been attempted in various forms, often using a tether of some kind to lock the skis, when embraced in the device, to some fixed support. However, the tether has no storage space in such devices, such as shown in U.S. Pat. No. 3,754,420 or 3,874,202 but rather is in a cumbersome relation with respect thereto.

SUMMARY OF THE INVENTION

An open rectangular device formed of four sides or members has one of these members movable from the side of the rectangle to admit skis into the open rectangle and then move back to closed position to hold the skis within the rectangular device. Pivotally related to another of the members of the rectangular frame is a spool on which a tether or steel cable may be wound with the spool movable into the opening in the rectangular framework when the skis are not present therein thus providing a compact relationship in the rectangular frame. The tether is used for securing the entire frame to some fixed object such as a post or the like and a single lock may lock the tether to the fixed object as well as locking the frame in its closed position with the skis therein.

DESCRIPTION OF THE PREFERRED EMBODIMENT

Figure 2:
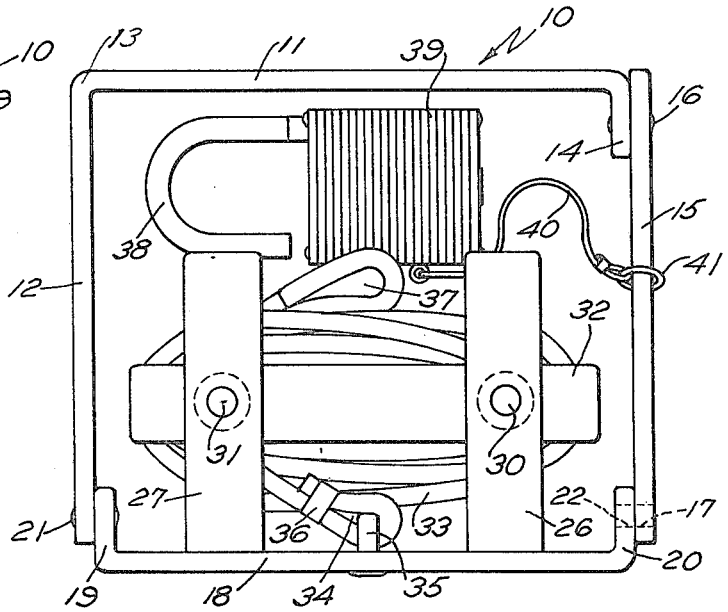
FIG. 2 is a top plan view of the rectangular frame with the skis removed and showing the cable for holding the frame to the post as coiled on a spool which is swung into the center of the framework for compact relation thereto and also showing a padlock similarly located which is used for securing the parts of the device in working locked position.
Figure 3:
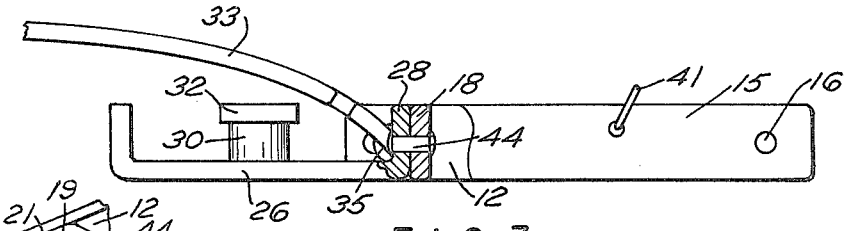
FIG. 3 is an end elevation, looking from the right of FIG. 2, of the structure shown in FIG. 2 with the spool swung from the center of the frame to a location outside the frame as shown in FIG. 1 and with the cable unwrapped from the spool and broken away, the same being in section adjacent the point of securing the spool to one member of the frame.
Figure 4:
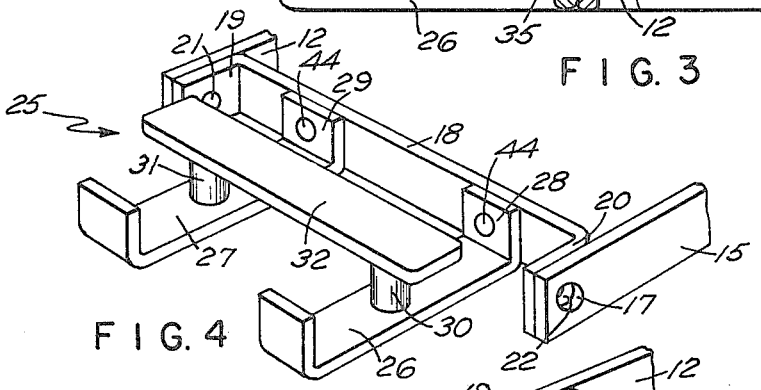
FIG. 4 is a perspective view illustrating the frame fragmentally with the spool as swung out of its storage position and with the cable removed.
Figure 5:
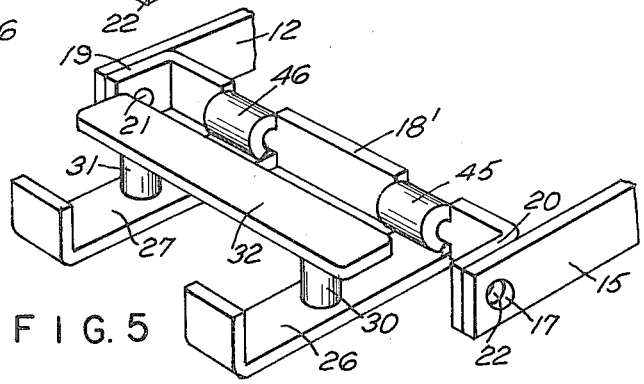
FIG. 5 is a perspective view similar to FIG. 4 but showing a modified form of construction.

With reference to FIG. 2 a frame designated generally 10 is shown in rectangular shape having two members 11 and 12 formed at right angles to each other by bending at 13 of a flat bar of metal into the right angular formation. One end of the member 11 is turned inwardly as at 14. Another or third member 15 is pivoted by means of pivots 16 at one end to the inturned end 14 on the member 11 of the framework and is provided at its other end with an opening shown at 17 (FIGS. 2 and 4). A fourth side of the rectangle comprises a member 18 of a generally flat bar with its ends 19 and 20 turned inwardly at right angles to the member 18 and it is pivoted by pivot 21 to the bar 12 so as to rotate about an axis parallel to the axis of the member 11 through a 180 or more degrees. The inturned end 20 of this member 19 is provided with a hole 22 which aligns with the hole 17 in the member 15.

Figure 1:
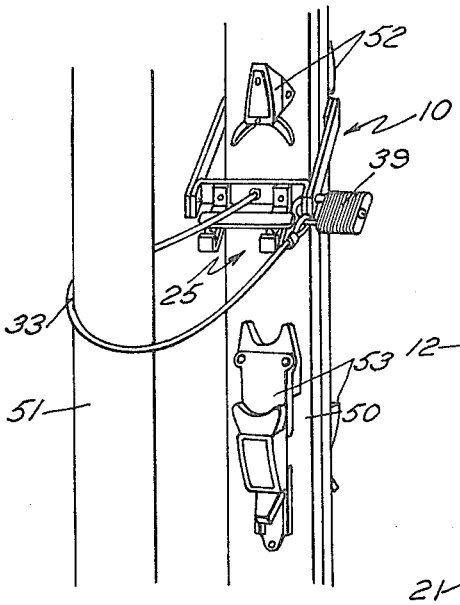
FIG. 1 is a perspective view illustrating fragmentally a pair of skis held in the device of this invention and secured to a post which is also broken away at its upper and lower ends.

Secured to the bar 18 there is a spool designated generally 25 as seen best in perspective in FIG. 4 which spool comprises a pair of arms 26 and 27 having ends 28 and 29 turned at right angles to these arms and secured to the bar 18 by rivets 44 or by welding. Posts 30 and 31 extend from the members 26 and 27 and are capped by a bar 32 so that a steel cable 33 may be wound about these posts 30 and 31 and beneath their caps 32 for storage as shown in FIG. 1. The cable 33 is attached to the member 18 by a loop 34 passing through an eye 35 and secured by a compressed band 36 in loop position. The eye 35 is riveted to the bar 18. This secures the cable fixedly to the rectangular frame. The other end of the cable is provided with a loop 37 for the passage of the hasp 38 of a padlock 39 therethrough. The padlock is secured to the movable member 15 by a flexible cable 40 having a ring 41 to embrace and be slidable along the removable member 15.

An alternate way of securing the spool to the member 18 would be to recess the member 18′ and wrap the end of the arms 26 and 27 about this recessed portion as at 45 and 46. Thus the spool in this case would pivot with relation to the member 18′ so that the member 18′ need not pivot with the spool to and from stored position.

In operating this device from the packaged storage position such as shown in FIG. 2, which may be placed in a pouch or the like for easy carrying, the spool would first be swung from its stored position as shown in FIG. 2 to its working position as shown in FIGS. 1, 3, 4 or 5. The member 15 would then be swung from its closed position as shown in FIG. 2 about its pivot 16 to open position an expose the center of the rectangular frame, and then the two skis designated as 50 in FIG. 1 could be placed in the frame. The member 15 is then swung back to closed position with its hole 17 registering with the hole 22 in member 18 and the steel cable in its unwrapped position may be then passed around a fixed post 51, whose ends are assumed to be closed, or attached to some other part. The cable could also be passed through hand loops on a ski pole and then the end loop 37 of the cable brought back so that its opening will align with the holes 22 and 17 and the hasp 38 of the padlock may be passed through these three parts as shown in FIG. 1 to lock all of the parts to the post 51 so as to deter stealing of the skis and ski poles.

When the skis are to be transported, the device will be unlocked and the cable will be wound around the spool 25 which will be swung into the open part of the frame as in FIG. 2 for compact storage. The padlock will be placed as shown in FIG. 2 and the entire device may be placed in a cloth or leather pouch for placing in the pocket of the skier.

When in the locked position the parts 52 and 53 on the upper surface of the back-to-back skis will prevent the sliding of the skis out of the frame 10.

I claim:

1. A portable locking means for skis comprising an open frame of generally rectangular shape having side members, a spool with flexible means wound thereon, spool mounting means including one of said members pivoting the spool on the frame to move from a position within the open frame to a position outside of said open frame, and locking means including said flexible means to lock the frame to an outside part.

2. A locking means for skis as in claim 1 wherein the member mounting the spool pivots with the spool.

3. A locking means for skis as in claim 1 wherein the spool pivots about said member on which it is mounted.

4. A locking means for skis as in claim 1 wherein the open frame is of a size to receive a pair of skis therein.

5. A locking means for skis as in claim 1 wherein the open frame is of a size to receive a pair of skis therein, means movably mounting another of said members for movement to admit a pair of skis into the open frame and for closing after the skis are admitted.

6. A locking means for skis as in claim 1 wherein the open frame is of a size to receive a pair of skis therein, means movably mounting another of said members for movement to admit a pair of skis into the open frame and for closing after the skis are admitted, said locking means also locking the movable member in closed position.

7. A locking means for skis as in claim 1 wherein the open frame is of a size to receive a pair of skis therein, means movably mounting another of said members for movement to admit a pair of skis into the open frame and for closing after the skis are admitted, said locking means also locking the movable member, said locking means comprising one end of the flexible member and a corner of the frame.

8. A locking means for skis as in claim 1 wherein the open frame is of a size to receive a pair of skis therein, means movably mounting another of said members for movement to admit a pair of skis into the open frame and for closing after the skis are admitted, said locking means also locking the movable member, said locking means comprising one end of the flexible member and a corner of the frame comprising eyes in the frame members and an eye at the end of the flexible member.

* * * * *